US005784531A

United States Patent [19]

Mann et al.

[11] Patent Number: 5,784,531

[45] Date of Patent: Jul. 21, 1998

[54] INSTANTANEOUS FLUID HEATING DEVICE AND PROCESS

[76] Inventors: Robert W. Mann, 4641 Westfield Rd; Herman H. Hall, Jr., 8256 Buttercup St., both of Jacksonville, Fla. 32210

[21] Appl. No.: 583,872

[22] Filed: Jan. 5, 1996

[51] Int. Cl.[6] ..... F24H 1/10

[52] U.S. Cl. ..... 392/494; 219/486; 219/509; 392/495; 392/490

[58] Field of Search ..... 392/465, 485, 392/488, 490, 316, 491–494, 471; 219/497, 512, 509, 490; 200/81.9 R; 340/606

[56] References Cited

U.S. PATENT DOCUMENTS

| | | | |
|---|---|---|---|
| 3,261,963 | 7/1966 | Weinstein | 392/488 |
| 3,349,755 | 10/1967 | Miller . | |
| 3,952,182 | 4/1976 | Flanders . | |
| 4,459,465 | 7/1984 | Knight | 392/494 |
| 4,620,667 | 11/1986 | Vandermeyden et al. | 392/471 |
| 4,638,147 | 1/1987 | Dytch et al. | 392/485 |
| 4,791,414 | 12/1988 | Griess | 340/606 |
| 5,020,127 | 5/1991 | Eddas et al. . | |
| 5,350,900 | 9/1994 | Inage et al. | 219/497 |
| 5,479,558 | 12/1995 | White, Jr. et al. | 392/485 |
| 5,504,306 | 4/1996 | Russell et al. | 219/497 |

FOREIGN PATENT DOCUMENTS 837240 3/1970 Canada .

*Primary Examiner*—Tu B. Hoang

*Attorney, Agent, or Firm*—Saliwanchik, Lloyd & Saliwanchik

[57] ABSTRACT

Instantaneous fluid heating device and process including an instantaneous fluid heating device which features forced fluid recirculation past/through heating elements/vessel featuring immersible electrical heating elements in a plurality of heating vessels arranged in series with all of said electrical heating elements/vessels being of equal electrical power/volume so as to be equal in overall heating capacity and receiving electricity simultaneously by on/off switching of electrical power via one or more solid state relays responsive to the minutest changes of temperature below/above the set point.

44 Claims, 13 Drawing Sheets

INSTANTANEOUS FLUID HEATING DEVICE AND PROCESS

BACKGROUND OF THE INVENTION

1. Field of the Invention

The apparatus and process taught herein relate generally to the field of fluid heating devices, including those adapted for the provision of heated water. More specifically, they relate to the provision of those types of fluid heaters that are typically referred to as "tankless," "instantaneous," and/or "on demand."

2. Prior Art in the Field

Fluid heating devices may be divided into two broad categories—storage or instantaneous. The storage type of fluid heater is by far the more common in most applications and relies on thermostatically controlled heating element(s) to bring a reservoir of fluid in a storage tank to the desired ("set point") temperature for use. It is still the unit of choice for most household and commercial uses. However, as outlined below, its shortcomings have led to attempts to develop instantaneous fluid heaters that do not utilize a storage tank, but instead rely on the heating of fluid only as demanded. These types of systems have also had numerous drawbacks, as hereinafter described.

Storage type fluid or water heaters are typically beset by numerous difficulties that are well know in the art. First, only a limited amount of heated fluid is available, as determined by the capacity of the storage tank. This results in situations where the amount of heated fluid in storage is totally consumed. It also may result in an extended period wherein the unheated fluid in the storage tank is being brought back to the set point temperature and heated fluid is, therefore, unavailable to the user. Second, energy is wasted due to the necessity of maintaining the temperature of the heated fluid in storage when it is not in use (i.e.—"standby loss"). Standby loss is exacerbated by the large size of the tank necessary to store heated fluid in reasonable amounts for the user and the heat loss from the large surface areas of such tanks. Third, systems of this type often accumulate a layer of sediment in the bottom of the storage tank. Such sediment may cover the heating element(s), resulting in decreased efficiency in heating the fluid in the tank. This, in turn, requires more extended operation of the heating element(s) in order to bring the fluid in the storage tank to the set point (It should be noted that other forms of temperature control such as proportional, PID, fuzzy logic, and staged as commonly known within the art could be used to achieve satisfactory temperature regulation). temperature with consequent increases in energy consumption/cost and a decrease in the useful life of the heating element(s) utilized. Fourth, systems of this type often have a shortened tank life due to the accumulation of sediment in the tank, and accelerated galvanic action and electrolysis that results from the constant storage of heated fluid within the tank. Fifth, as heated fluid is drawn by the user, incoming cold fluid decreases the temperature of the remaining fluid in storage. This results in a need for continual adjustment of the balance of hot and cold fluids being mixed by the consumer at the point of use in order to compensate for cooler storage tank output temperatures. Sixth, the size of the tank required for storage results in the loss of space that would otherwise be available for other uses. It also limits the possibilities for fluid heater installation to those situations where sufficient space is available. This, in turn, may eliminate the option of installing a fluid heater. Alternatively, it may require its placement at an inappropriate location relative to the point of use, resulting in longer piping, decreased efficiency and a longer period of time to deliver heated fluid to the point(s) of use. Seventh, the heating element(s) located in the storage tank cannot be serviced or replaced without great inconvenience, typically requiring the draining and wasting of fluid in the tank.

The aforesaid difficulties have led to numerous attempts to develop electrically powered instantaneous and/or on demand type fluid heaters. The features of these types of fluid heaters differ widely. Thus, there are numerous variations in the method of power distribution and the nature and design of the heating element(s) utilized, the temperature control means/system utilized (if any), and the manner in which fluid flowing through the device is directed and manipulated. One primary distinction between such fluid heaters relates to the last variable mentioned—the manner in which fluid flowing through the device is directed and manipulated. In this regard, instantaneous fluid heaters may be divided between: (a) those in which fluid to be utilized flows through/past one or more heating vessels/elements before it leaves the apparatus; and (b) those that also rely to some degree on forced recirculation of some portion of the fluid heated thereby through/past these same vessels/elements before it leaves the apparatus.

Instantaneous fluid heaters within the first category described range from relatively small and uncomplicated devices of the type utilized for coffee makers or similar uses to much more complicated and larger devices intended for general household, commercial or industrial uses. Typical examples of the smaller type of device may be found in U.S. Pat. No. 4,371,777 for a "Continuous Flow Electric Water Heater" and in U.S. Pat. No. 4,558,205 for an "Electric Continuous Flow Water Heater Having Dual Temperature Safety Limiting Devices." Typical examples of larger devices within this category may be found in U.S. Pat. Nos. 3,230,346 ("Electric Continuous Flow Heater Having a Plurality of Heating Channels"); 3,909,588 ("Temperature Control System for Electric Fluid Heater"); 3,952,182 ("Instantaneous Electric Fluid Heater"); 4,604,515 ("Tankless Electric Water Heater with Staged Heating Element Energization"); 4,808,793 ("Tankless Electric Water Heater with Instantaneous Hot Water Output"); 4,970,373 ("Electronic Temperature Control System for Tankless Water Heater"); and 5,020,127 ("Tankless Electric Water Heater").

Far fewer examples of instantaneous fluid heaters within the second category described, those that rely to some degree on the forced recirculation of the fluid heated in the device to achieve their aims, are to be found in prior art. The first example of such a device known to the inventors is seen in U.S. Pat. No. 3,349,755 issued to A. L. Miller in 1967 for a "Recirculating Flow Water Heater" based on steam heating. In the Miller device, which is typical of devices in this category, cold water enters a first plenum which is in communication with the interior of a first plurality of heated tubes. These tubes are, likewise, in communication with the interior of a second plenum. Water is drawn from the first plenum into the second plenum via a pump connected intermediate the second plenum and a third plenum. This pump forces the water received from the second plenum into a third plenum and from there through a second plurality of heated tubes to a fourth plenum. The fourth plenum has a first outlet whereby heated water can be drawn off for use and a second outlet leading back into the first plenum. The rate of flow induced by the pump is substantially greater than the rate of flow induced by the use of the consumer. Thus, a substantial amount of the water entering the fourth plenum after being heated is returned to the first plenum where it mixes with incoming cold water and serves to preheat such water before it is circulated through the heating tubes. A second example of the recirculating category of instantaneous water heaters is seen in U.S. Pat. No. 4,046,189 issued to John A. Clark in 1977 for a "Water Heater." The Clark device, like the Miller device described above, relies on steam heating. Unlike Miller, it incorporates a small heat exchange/storage vessel through which water being heated is recirculated. It is, therefore, more representative of a hybrid category of fluid heaters which attempt to combine the features and advantages of instantaneous water heaters with a more limited storage tank than would usually be found in a storage type water heater.

Heretofore, however, instantaneous fluid heaters in both categories set forth above have been subject to numerous problems which have limited their acceptance and use in most applications. First, most have lacked the ability to provide extremely accurate temperature regulation across a wide range of flow demands and a concurrent inability to react quickly to changes in flow demands. Second, they have generally lacked the ability to safely and/or effectively handle full power in low flow demand situations. Third, the performance of such systems cannot, in most situations, equal or exceed that of conventional storage tank systems in terms of temperature set point maintenance. They may not, therefore, be considered a viable substitute in such situations. Fourth, they generally provide an inadequate quantity of heated fluid at the desired set point temperature for the user. Fifth, they lack flexibility in that most are generally responsive to flow demands only within a narrow band. Thus, those that function well for high flow demands often function poorly in low flow demand situations and vice versa. Sixth, some rely on staged energization of heating elements, such that heating elements are activated/energized in increasing numbers as flow demand increases. This often results in significant deviation from the temperature set point when the flow rate varies from the flow rate range at which a certain number of heating element is activated to the flow rate range at which an increased number is activated. Seventh, they are often characterized by poor temperature set point recovery as demands for flow change during use. Eighth, they do not usually provide adequate temperature set point regulation when flow demands require less than full rated power. Alternatively, they do not usually provide means for user adjustment of the set point. Ninth, they often require specialized heating elements or excessively advanced (and expensive) technology and components (i.e.—microprocessors, multiple temperature sensors, microwave heating technology, etc.) for their function. Tenth, such systems are generally not designed for long term serviceability and must, therefore, be replaced when malfunctioning. Eleventh, they are often limited in terms of their field of use, and are not compatible with usage in a wide variety of industrial, commercial, medical and residential applications. Twelfth, they are seldom designed in a manner which provides for optimum sediment removal or are not inherently self cleaning.

SUMMARY AND OBJECTS OF THE INVENTIONS

A. General Summary of Inventions and Objects Thereof

It is an object of the instant inventions to overcome all of the previously described limitations and problems associated with instantaneous and storage type fluid heaters through the provision of a fluid heating process and device that is simple and rugged in construction, durable, easily maintained and inherently self cleaning, and functions efficiently in a great variety of applications within a wide range of flow rates. The instantaneous fluid heating device and process with its related subsystems (for fluid manipulation, electrical control, electrical power distribution and temperature control) as taught herein is capable of accurately regulating a preselected fluid temperature set point regardless of suddenly induced changes in flow demands for a virtually unlimited range of varying flow rates, electrical power requirements and applications, and represents a tremendous improvement in performance, reliability, safety, and simplicity as compared to any published data available for other systems known by the inventors.

In its most basic embodiment the instant invention features forced fluid recirculation past/through one or more heating element(s)/vessel(s) featuring immersible electrical heating element(s), which said plurality of heating element (s)/vessel(s) is arranged in series with all of said heating element(s)/vessel(s) being equal in heating capacity and all of said heating element(s) receiving electricity and being switched on/off simultaneously via one or more solid state relays which respond to a control signal from a temperature control system having a temperature sensor that is responsive to the minutest changes in temperature below/above the set point temperature. In its preferred embodiments it relies on and is characterized by a combination of: (a) forced fluid recirculation past/through heating elements/vessels featuring immersible electric heating elements in a plurality of heating vessels arranged in series with all of said heating elements/vessels being equal in heating capacity and each having its electricity switched on/off simultaneously; (b) a master electrical control means which features start-up, general control and safety features (as further summarized in section "B," below); (c) one or more solid state relays which serve as electrical power distribution means for said heating elements and are, preferably, cooled by incoming fluid and can, therefore, simultaneously serve to pre-heat such fluid before it enters the aforesaid heating vessels (as further summarized in section "B," below); and (d) an instantaneously reactive on/off type of temperature control and regulation means (i.e.—one having no "dead band" around the temperature set point) which is responsible for providing the on/off control signals to the aforesaid solid state relay(s) and which features an extremely sensitive immersion sensor located within or proximate the intake for the device's recirculation pump and fluid outlet (as further summarized in section "C," below).

B. Objects and Summary of Electrical Systems

1. General Objects and Summary

It is a specific object of the instant invention to overcome the previously described limitations and problems associated with safely and effectively providing electrical power for instantaneous fluid heaters through the provision of master electrical control and electrical power distribution systems suitable for use with same. It will be found that electrical systems constructed in accordance with the teachings of this invention are simple and rugged in construction, durable, easily maintained, and function efficiently in a great variety of applications within a wide range of flow rates and electrical power requirements and can be adapted for use in either static or recirculation types of instantaneous fluid heaters. The electrical systems for instantaneous fluid heating devices taught herein are capable of controlling overall system functions and safely supplying electrical power so as to allow the accurate regulation/control of fluid temperature set point and fast set point recovery when user induced changes in output flow occur. It retains this capability (despite suddenly induced and drastic changes in flow demand) for a wide range of overall electrical power requirements. (This potential requires the ability to rapidly switch high amperage loads between on/off states in response to the minutest perceived changes in temperature). Further, they have proven capable of maintaining this desirable characteristic across a wide range of varying flow rates and should, theoretically, be capable of maintaining this desirable characteristic across an infinite range of flow rates and overall electrical power requirements (as determined/required by a particular application). Moreover, the systems and processes utilized have been found to be simple, safe and reliable, and can be employed in self contained devices or integral systems that provide precise control and regulation of the output fluid temperature in low powered and high powered applications, including residential home water heating applications (in lieu of conventional hot water tanks), and scientific, medical, industrial and commercial applications.

In their most basic embodiments, the electrical systems utilized with the instant invention rely on the utilization of at least one electrical relay (preferably a solid state relay) to relay electricity to the heating element(s) employed in the system, which solid state relay is (a) disposed in such manner as to be actively cooled by incoming fluid, and (b) may be indirectly deactivated by one or more high temperature limiting safety switches, which switches are normally closed, but open at high temperatures (discontinuing necessary control voltage(s)) so as to terminate the supply of electricity to such element(s).

2. Detailed Summary of Master Electrical Control System

In its preferred embodiments, the master electrical control (and safety) system depends on a supply of electricity which may be terminated by thermal safety switch(es) and is activated by an application specific means such as a flow sensing, temperature sensing, and/or manually actuated switch(s), thereby supplying control ("on") voltages to (a) the electrical power distribution system; (b) the temperature control system (which is summarized in more detail in section "C," below); and (c) a pump used for the purpose of recirculating fluid through/past the heating vessels/elements of the device.

3. Detailed Summary of Electrical Power Distribution System

In the preferred embodiments of the electrical power distribution system, at least one electrical relay (preferably a solid state relay) is utilized to relay electrical power to the heating elements employed in the system, which solid state relay(s): (a) receive control ("on") voltage(s), depending on the number of relays and their configuration, from the previously described master electrical control or from the temperature control system described below (and is/are, therefore, in both cases, susceptible to being indirectly deactivated by the operation of previously mentioned thermal safety switch(es)); (b) may employ either a single redundant safety system or a double redundant safety system (both being indirectly responsive to the aforesaid thermally actuated high temperature limiting safety switches) for a typical single phase or three phase alternating current voltage supply ("ACv") with (i) single redundant safety requiring at least one solid state relay capable (directly or indirectly) of interrupting the ACv supply to the heating element(s), and (ii) double redundant safety requiring at least one additional solid state relay capable (directly or indirectly) of interrupting the ACv supply and the heating element(s); and (c) said solid state relay(s) are mounted on a heat exchange vessel (or vessels) so as to provide maximum cooling by incoming fluid, which heat exchange vessel (or vessels) can incorporate false activation suppression characteristics (as described, infra) if desirable for the particular application.

C. Summary and Objects of Temperature Control System

Upon review it will be found that many of the problems associated with instantaneous type fluid heaters, as detailed in the "Background" Section above, are due to, or exacerbated by, the lack of temperature detection/control systems or the slow response speed of the temperature detection/control systems utilized by same. Thus, it is a specific object of the temperature control system utilized in the instant invention to overcome the previously described limitations and problems through the provision of a temperature control system that, like the fluid heating system it supports, is instantaneous in operation. This has been accomplished through the provision of a temperature control system that is simple in construction, durable, and functions efficiently in a great variety of applications and within a wide (and possibly infinite) range of flow rates. The temperature control system and process for instantaneous fluid heating devices taught herein greatly facilitates the accurate regulation of fluid temperature set point despite suddenly induced changes in flow demands. Further, it is capable of maintaining this desirable characteristic across a wide (and possibly infinite) range of varying flow rates (as determined by the application).

In its most basic preferred embodiments it relies on and is characterized by: (a) a purely reactive on/off type of temperature control and regulation means which is instantly responsive to (b) an extremely sensitive (i.e.—"fast") immersion sensor located within the recirculation path proximate the outlet port for the instantaneous fluid heater. Thus, it is designed in such a manner as to have no inoperative deadband around the temperature set point and, therefore, can respond instantly to perceived changes in the temperature set point. In its preferred embodiments, as illustrated herein, the aforesaid system may advantageously be utilized in conjunction with the novel electrical power distribution system also developed by the inventors and described herein. The system and process utilized have been found to be simple, safe and reliable, and can be employed in a self contained device for low powered applications or in an integral system for higher powered applications. It allows for user adjustment of the fluid output temperature by means of a temperature set point adjustment control. In operation, when the temperature sensor senses the smallest rise or fall above or below the selected set point temperature, the temperature control system instantly signals one or more electrical relays (preferably solid state electrical relays) to terminate or apply electric power to all heating elements simultaneously, irrespective of the amount (which may be infinitesimal) the temperature has risen or fallen, in order to maintain the temperature set point. In this manner, the output temperature can be closely maintained relative to the set point from extremely low flow rates to flow rates faster than the heater's ability to maintain the set point temperature with the heating elements remaining on continuously.

DETAILED DESCRIPTION OF PREFERRED EMBODIMENT

Figure 1:
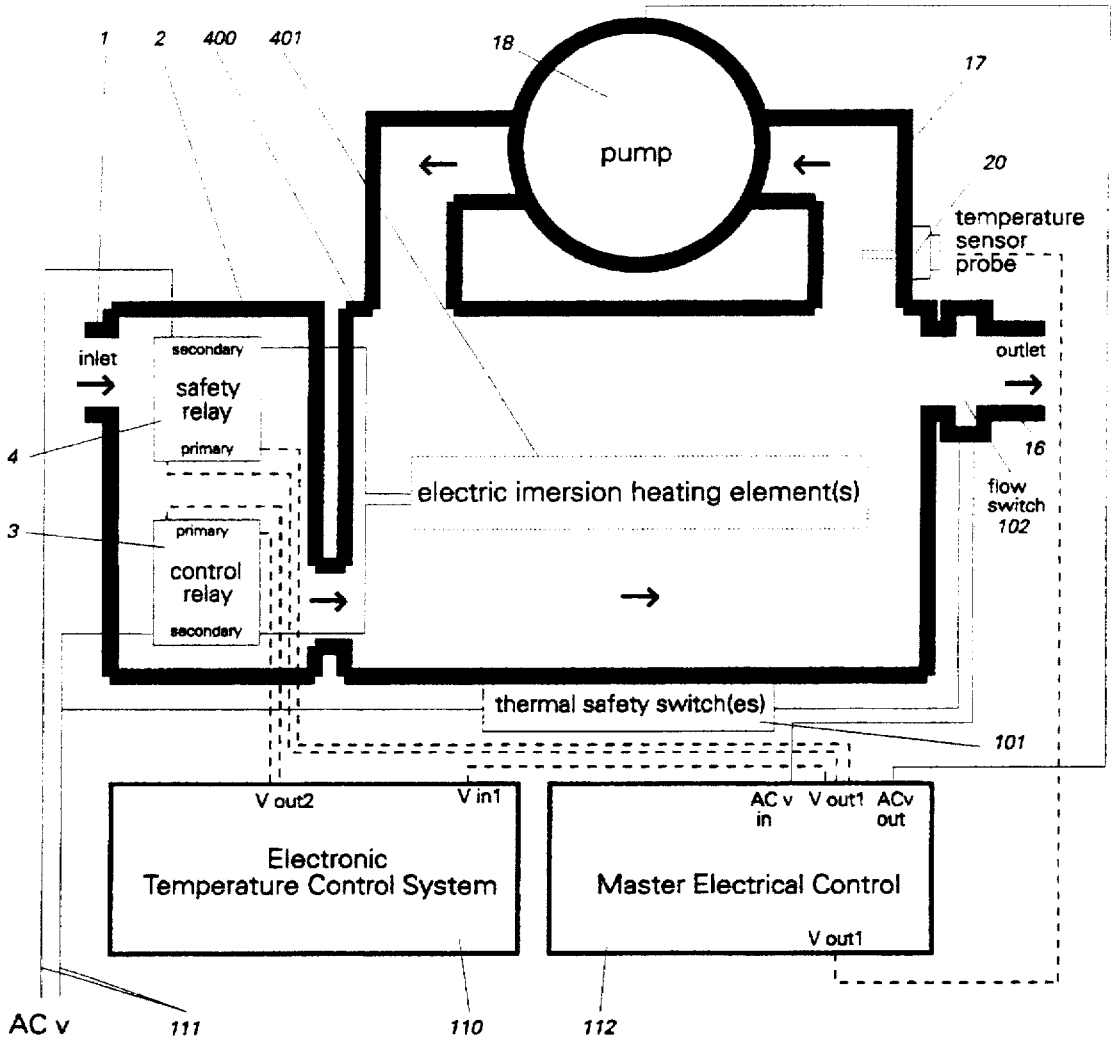
FIG. 1 illustrates, in conceptual fashion, the overall process and interrelationship between the physical, electromechanical, electrical, and electronic components of the apparatus and process utilized in the instant invention. In particular, it illustrates the interrelationship of forced recirculation, simultaneous on/off switching of heating elements through the temperature control means, and double redundant power distribution in one preferred embodiment.
Figure 2:
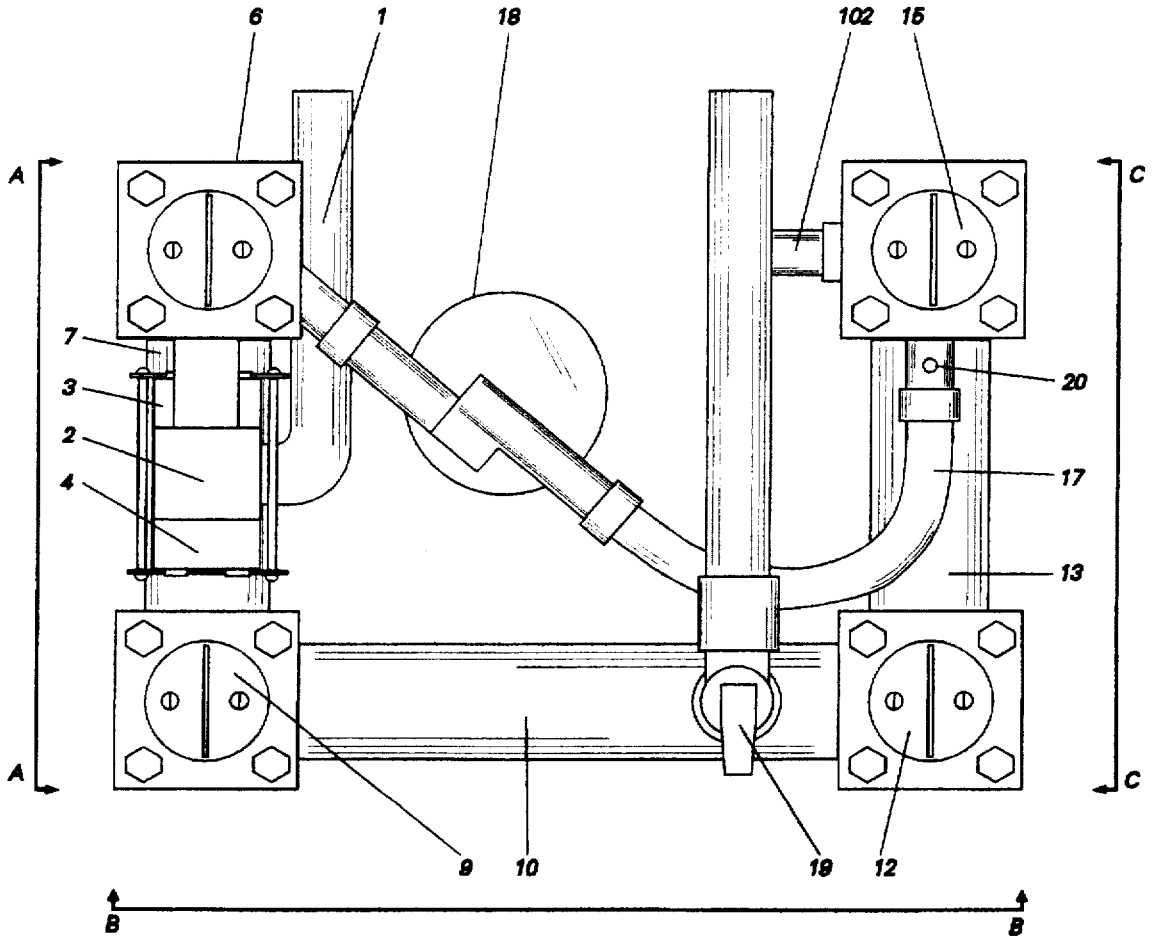
FIG. 2 provides a view from above of a preferred embodiment of the instant invention.
Figure 3:
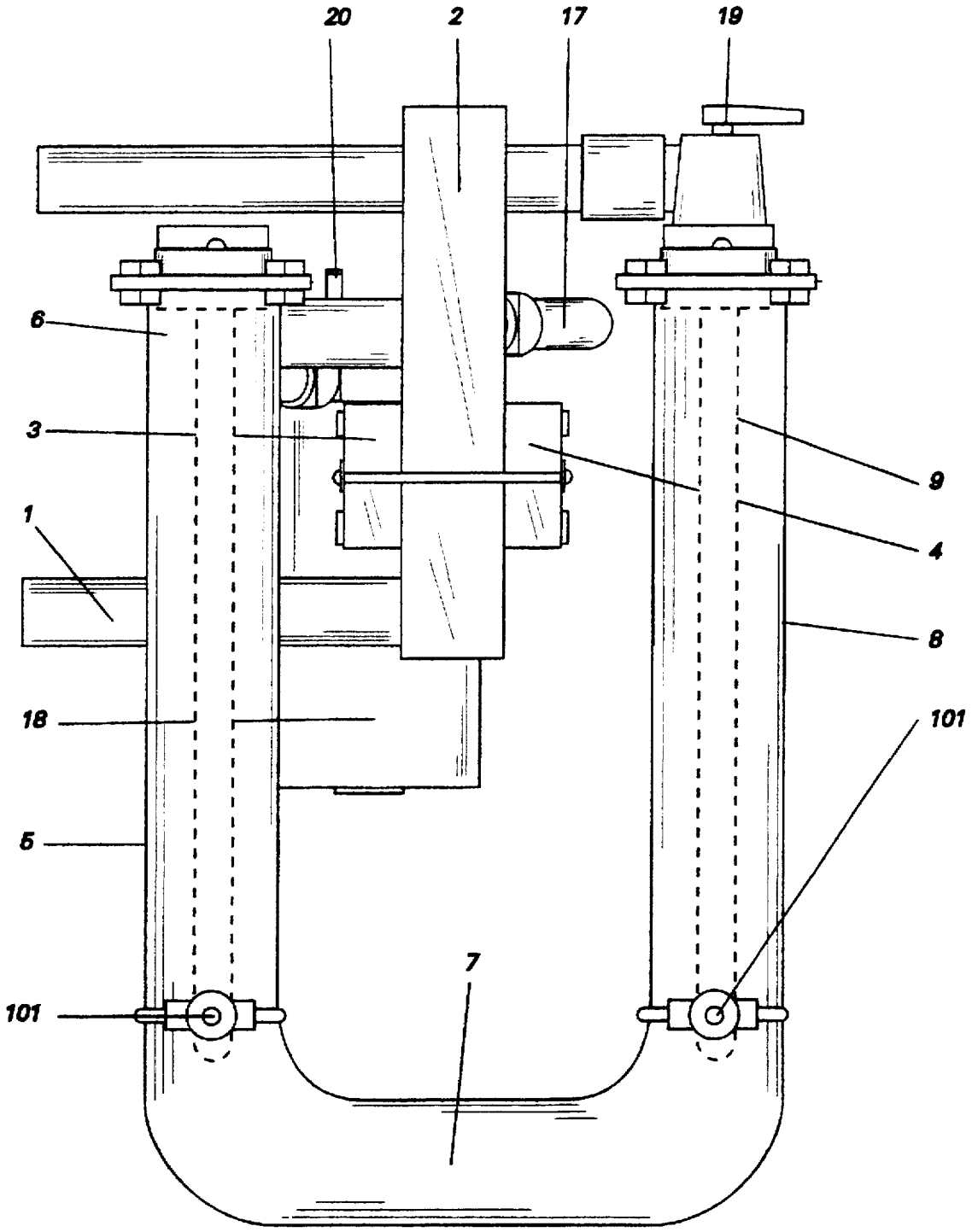
FIG. 3 provides a first side view of a preferred embodiment of the instant invention taken along line A—A of FIG. 2.
Figure 4:
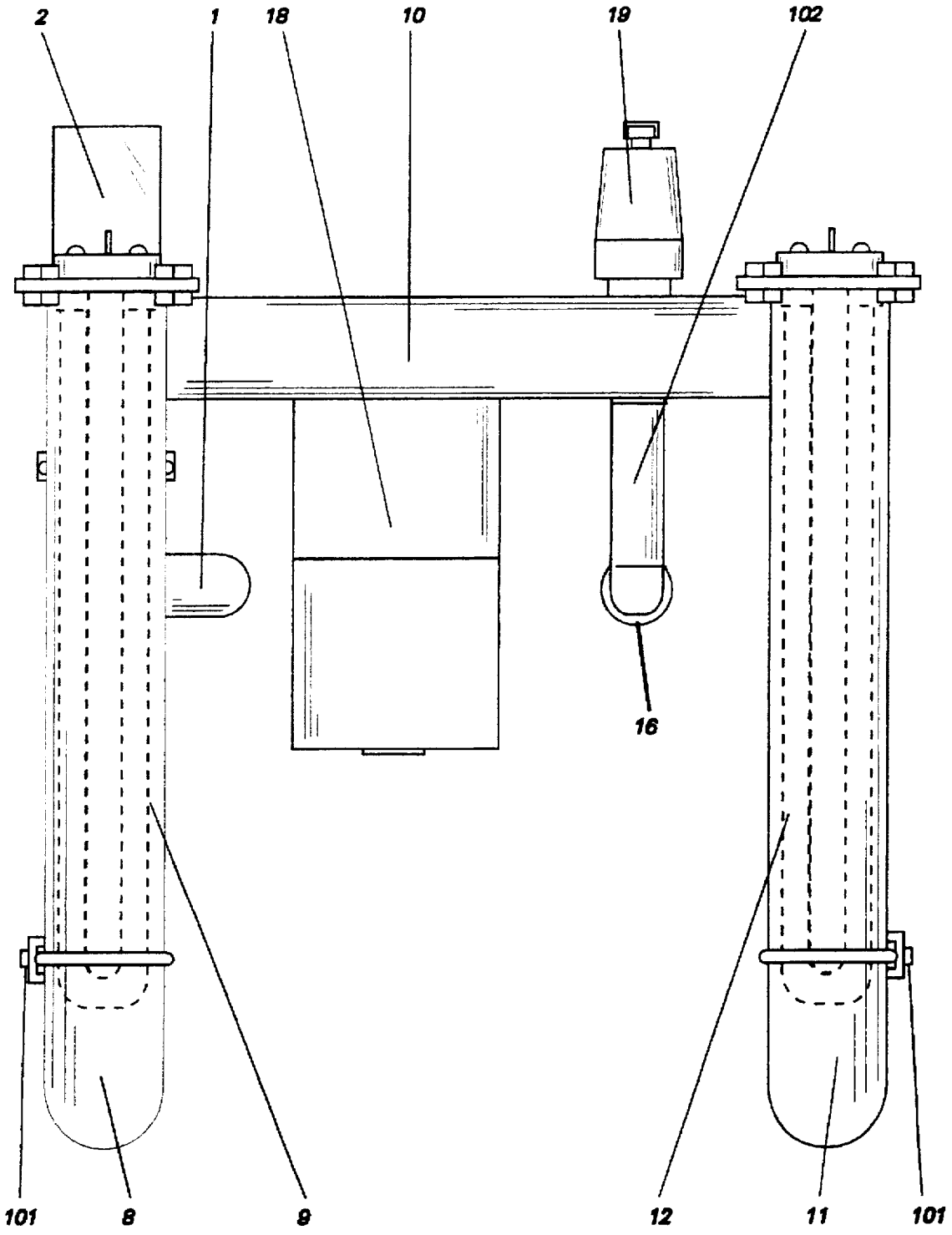
FIG. 4 provides a second side view (at right angles to that provided in FIG. 3) of a preferred embodiment of the instant invention taken along line B—B of FIG. 2.
Figure 5:
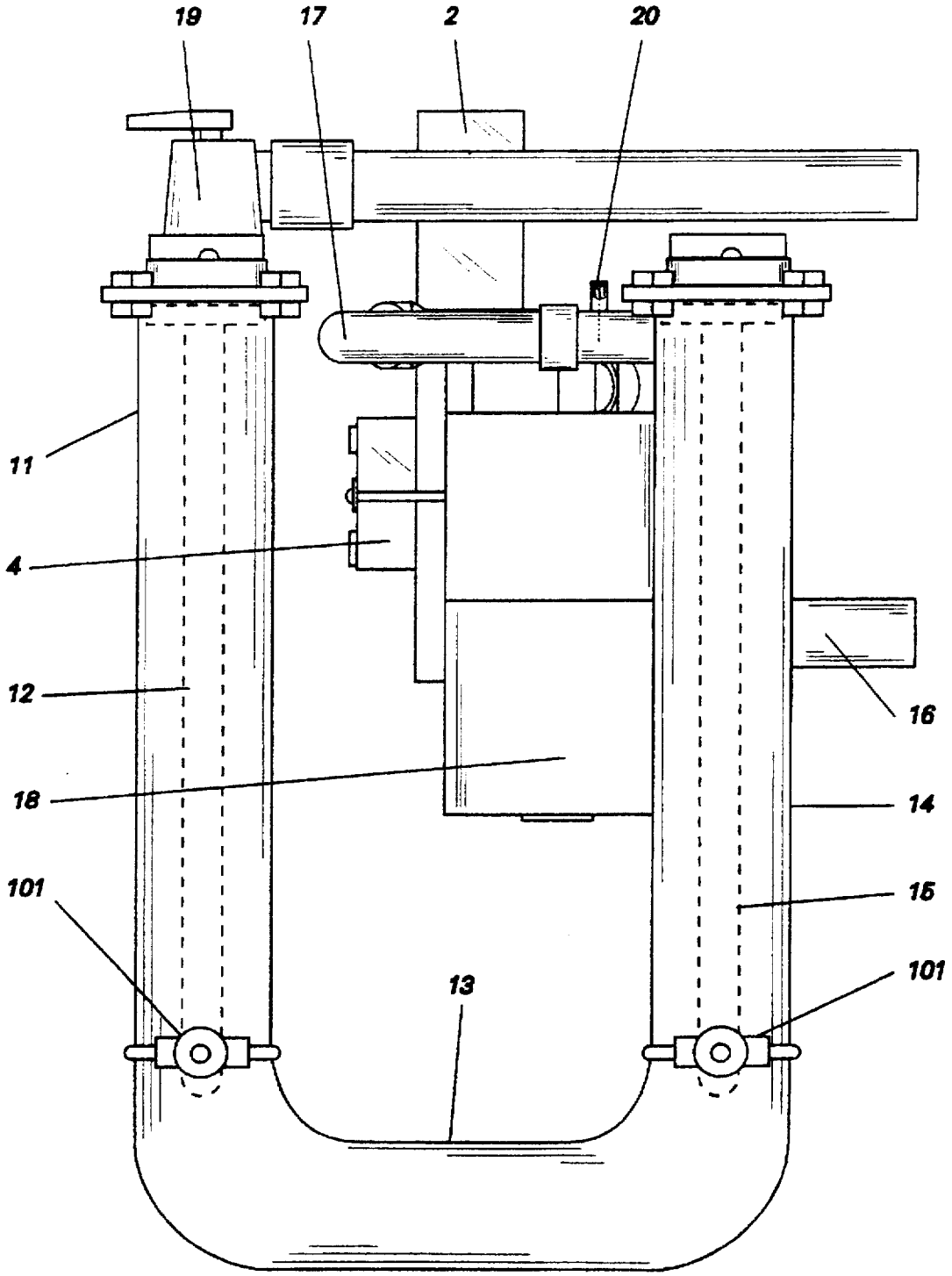
FIG. 5 provides a third side view (at right angles to that provided in FIG. 4 and from the opposite side from that provided in FIG. 3) of a preferred embodiment of the instant invention taken along line C—C of FIG. 2.

As illustrated in FIGS. 1 through 5, the Instantaneous Fluid Heating Device taught herein is compact in configuration. (This is, in fact, one of its major advantages over conventional tanks). In its most basic embodiments it may be considered to be comprised of four basic subsystems: (a) a basic fluid heating and recirculation structure; (b) a master electrical control system; (c) an electrical power distribution system; and (d) a temperature control system. The basic physical structure (i.e.—the fluid heating/recirculation structure) of the device is described in Section I, below. The master electrical control systems for the device are described in Section II, below. Its electrical power distribution system is described in Section III, below. Finally, its temperature control systems are described in Section IV, below. Notwithstanding its simplicity, the synergistic combination of the preferred embodiments of these systems in the preferred embodiment of this invention has been able to achieve results, in experimental prototypes, which far exceed those of any electrically powered storage or instantaneous fluid heating device known to the inventors.

I. Basic Fluid Heating and Recirculation Structures

The fluid heating/recirculation structure characterizing the instant device and its operation may best be understood by reference to FIGS. 1 through 5. As will be noted, the device taught herein is provided with an inlet port 1, which is in communication with an outside source of fluid to be heated (not shown). Upon entering the device via inlet port 1, such fluid flows into a heat exchange vessel 2, upon which are mounted a first solid state relay (hereinafter designated as the "control relay 3") and a second solid state relay (hereinafter designated as the "safety relay 4"). After being preheated via the heat released from these relays the fluid enters the main heater core, which is comprised of one or more heating vessels of equal volume and electrical power (i.e.—of equal heating capacity), with the exact number of heating vessels, heating elements and the fluid volume of each heating vessel being application specific.

In the embodiment illustrated in FIGS. 2 through 5, four such vessels are utilized. Thus, after exiting the heat exchange vessel 2, the preheated fluid enters the first heating vessel 5 where heat is applied by the first heating element 6. (See, FIG. 3). As fluid leaves the first heating vessel 5 it progresses through first connector 7 to the second heating vessel 8 where additional heat is applied via the second heating element 9. In the embodiment illustrated, fluid then flows via second connector 10 to the third heating vessel 11 where the fluid collects additional heat from the third heating element 12. (See, FIG. 4). The fluid flows through the third connector 13 to the fourth heating vessel 14 where it receives heat from the fourth heating element 15. (See, FIG. 5).

After the fluid has flowed through all of said heating vessels in sequence, and before exiting past the flow switch 102 (see, FIG. 2) via the outlet port 16 (see, FIG. 4), the majority of the heated fluid is recirculated past an enclosed immersion type micro-miniature thermistor probe assembly 20 (see, FIGS. 1, 2, 3, 5, 16 and 17) through a suitable conduit 17 back into the first heating vessel 5. This recirculation is accomplished by a sealless, magnetic drive pump 18 attached to conduit 17 between fourth heating vessel 14 and first heating vessel 5. While the apparatus is in operation, recirculation is continuous, with the exact speed of recirculation also being application specific. Heated fluid being drawn off exits the apparatus via the outlet port 16. A temperature and pressure relief valve (T&P valve 19) is provided as an automatic emergency release valve for overheated fluids from the device. A valve that will release at 150 PSI and/or 210° F. may advantageously be utilized for this purpose.

In reviewing the specific physical embodiment described in this section the following should be borne in mind: The specific physical embodiment of the primary heat exchange vessel(s) (i.e.—heating vessels 5, 8, 11 and 14, and associated heating elements) responsible for heating the fluid itself, while still conforming to the fluid heating process developed by the inventors, is a function of application specific requirements based on the desired warm-up time for heating the fluid, the desired maximum outflow of heated fluid, the desired maximum heated temperature of the fluid, the maximum allowable transfer rate of heat to the fluid itself, the maximum allowable rate of forced recirculation of the fluid itself, the response time of the temperature sensor utilized, and the maximum allowable temperature deviation above and below the desired set point temperature. Thus, as these functions directly impact the variable design characteristics of the primary heat exchange vessel(s), numerous design constants, such as total fluid capacity, total electrical kilowatt power of the heating elements, the speed or presence of forced fluid recirculation, the total number of heating elements used, the mass of fluid heating structure; and the number of heating vessels employed, may be varied to meet specific design objectives.

II. Master Electrical Control System

A. Overview of System

Figure 6:
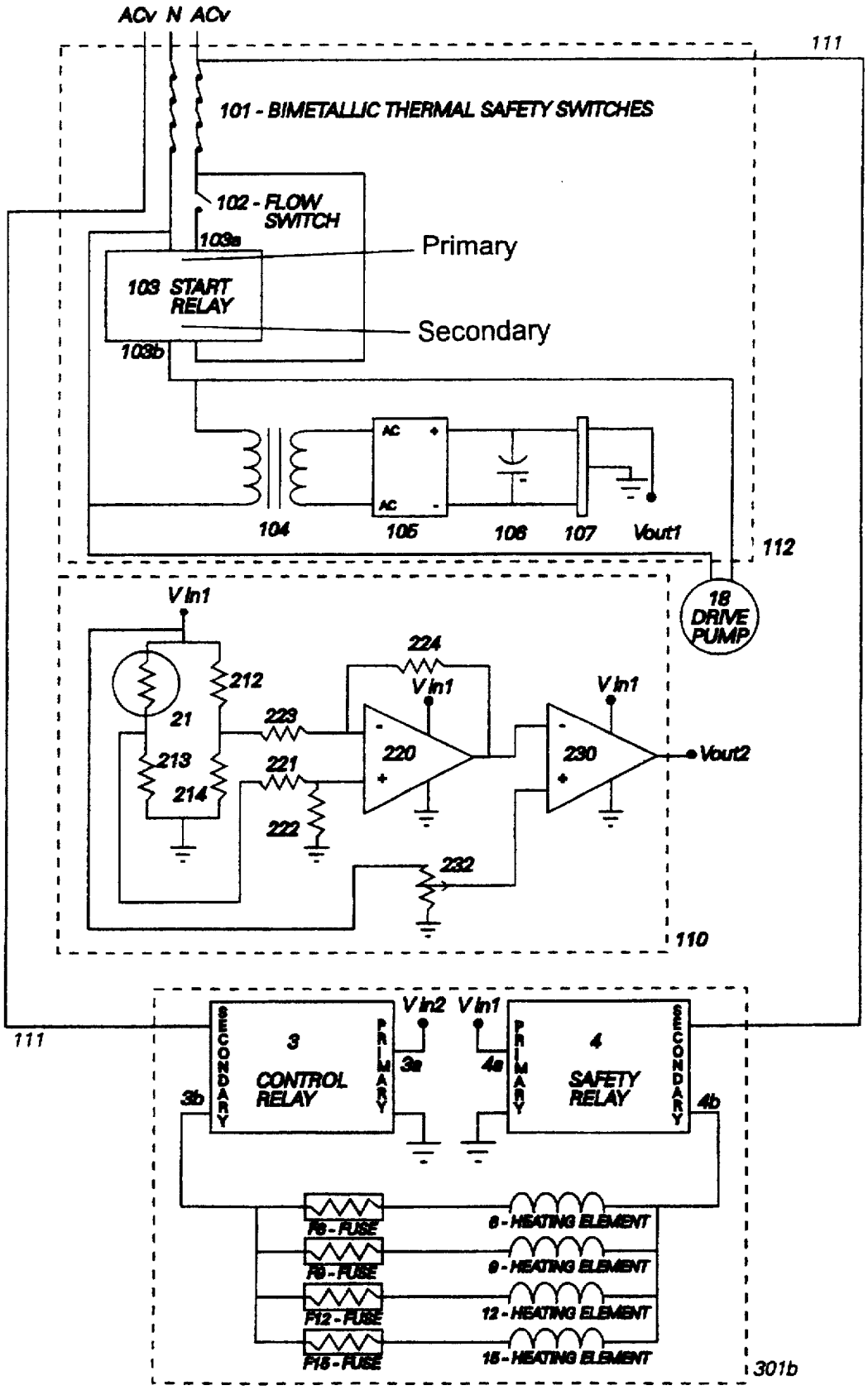
FIG. 6 provides, in schematic form, a detailed view of all electrical systems of the instant invention, including the circuit diagram of the essential circuits employed in the preferred embodiment of the master electrical control system, the temperature control system, and (by way of illustrative example and not of limitation) the preferred embodiment of the double redundant electrical power distribution system described in more detail with respect to FIG. 8.

The master electrical control system 112 for the device can best be understood by reference to FIG. 1 (which provides a conceptual overview of the entire invention) in conjunction with FIG. 6 (which includes additional diagrams of the temperature control system 110 for the device and one embodiment of its electrical power distribution and safety system 301*b*). Turning to FIG. 6, it will be noted that the master electrical control system 112 (which includes components 101, 102, 103, 104, 105, 106, and 107, and is also referred to herein as the "MEC") for the device includes a series of normally closed bimetallic thermal safety switches 101. These bimetallic thermal safety switches 101 conduct low amperage AC voltage to the normally open flow switch 102 and the normally open secondary circuit 103*b* of start relay 103. Electricity is conducted by flow switch 102 when closed. Flow switch 102 is, in turn, solely responsible for providing electricity to primary circuit 103*a* of start relay 103. Upon closing of the primary circuit 103*a* of start relay 103, the secondary circuit 103*b* of start relay 103 closes and provides AC voltage to a miniature ACV/ACV step down transformer 104 and recirculation pump 18. The reduced voltage output from transformer 104 provides input voltage to DC bridge rectifier 105 which provides low DC voltage output. Capacitor 106, which is connected in parallel across outputs of bridge rectifier 105, reduces AC voltage ripple to within acceptable limits. Voltage regulator 107 L provides regulated DC voltage Voult to the inputs of the components comprising the temperature control and electrical power distribution systems of the instant invention at points labelled Vin1 in FIG. 6. The start relay 103 could also, advantageously, have a time delayed secondary to aid in false activation suppression. The reasons for this feature (i.e.—false activation suppression) and other solutions to the problem of false activation are described in more detail in Section III, below.

B. Indirect Deactivation Feature

As previously noted, the master electrical control system 112 provides control voltages to the temperature control system 110 and the pump 18. It may optimally be designed to provide such control voltages when engaged and when triggered by flow switch 102 when there is a fluid flow through the device, when manually actuated, and/or through some other application specific means. The master electrical control 112 is, however, ultimately dependent for electrical power upon one or more bimetallic thermal safety switches 101, as previously discussed. Each bimetallic thermal safety switch is in thermal communication with the fluid in the device via physical contact with heat conducting surfaces of the device. Thus, if the temperature of the system rises to the rated limit of any of the thermal safety switches 101 they or it will serve to interrupt the flow of electrical power to the master electrical control 112 which provides control voltages to the pump 18 and the temperature control system 110. When the flow of electricity to the temperature control system 110 is terminated by the opening of any of the normally closed bimetallic safety switches 101, the temperature control system 110 cannot, in turn, provide primary or control voltages to the control relay 3, thereby opening circuit 111 and terminating the flow of electrical power to the heating element(s) 6, 9, 12, and 15 (jointly denoted 401 in FIG. 1). (It will also be noted that the circuit encompassing these heating elements should advantageously be provided with fuses F6, F9, F12, and F15 as illustrated in FIGS. 6, 7, 8, and 9).

The provision of indirect deactivation means is rendered more desirable due to the possible employment of high powered electrical heating elements, which can be utilized for certain fluid heating applications, and the need to respond quickly and reliably to the potential for rapid overheating which could result, regardless of the heating power required for such applications (in the unlikely event of system failure). An additional advantage of indirect deactivation is that it allows the use of bimetallic thermal safety switches rated for low amperage loads. Direct deactivation by bimetallic thermal safety switches wired in series with the electrical heating element(s) would require several thermal safety switches rated for the full amperage of the electrical heating element(s) being deactivated. Conversely, indirect deactivation allows the use of much smaller, faster, less expensive bimetallic thermal safety switches. Further, with regard to direct deactivation, bimetallic thermal safety switches rated for the high amperage electrical loads envisioned for many projected applications of this device do not exist. The bimetallic safety switches 101 utilized are ½ inch, bimetallic, matte finish discs which are encased in a sealed housing and affixed to heating vessels 5, 8, 11, and 14, at the points of highest potential external temperature, utilizing a suitable heat sink compound. The synergistic combination of these design features as a means for providing reliable and rapid response to possible overheating for theoretically unlimited application specific fluid heating power requirements is, to the best of the inventors' knowledge, unknown in prior art.

III. Electrical Power Distribution and Safety System

The electrical power distribution and safety system characterizing this invention can best be understood by reference to FIG. 1 in conjunction with FIGS. 6 through 15. As noted in Section I, above, fluid entering the device via inlet 1 must initially traverse a heat exchange vessel 2 on which is mounted at least one solid state electrical relay (control relay 3). (See, generally, FIGS. 1 through 5). The control relay 3 serves primarily to relay electrical power from an alternating voltage source external to the device to the electrical heating elements of the device in response to the master electrical control means 112 described in Section II, above. This external source is denoted as ACv in FIG. 1 and FIGS. 6 through 9 and is illustrated as single phase in these drawing figures for ease of understanding; however, this invention could easily be adapted for three phase operation by those skilled in the art.

The addition of heat exchange vessel 2 intermediate inlet 1 and first heating vessel 5 and the positioning of control relay 3 thereon (as illustrated in FIGS. 1 through 5 and FIGS. 10 through 15), serve two important purposes. First, the control relay 3 is actively cooled by the flow of incoming unheated fluid. Second, while serving as a heat sink for the control relay 3, the fluid traversing the heat exchange vessel 2 is preheated prior to entry into the first heating vessel 5. This serves to improve the overall efficiency and performance of the device by reducing the amount of heat necessary to be transferred to the fluid by heating elements 6, 9, 12, and 15, productively utilizing incoming energy that would otherwise be lost as waste heat from the control relay 3, and helping to heat the fluid prior to its entry into the first heating vessel 5 while simultaneously providing the maximum cooling possible to relays 3 and 4.

Even with the added safety produced by the presence of active cooling of the electrical relays utilized, it is advantageous to safeguard the system and the user from the possibility that, either by the unlikely failure of some system component or for some other reason, electrical power will continue to flow to the heating elements even when the temperature of the fluid being heated has reached levels in excess of those deemed safe for the system. Thus, the embodiment illustrated can incorporate one of three application specific safety features, as can best be appreciated by reference to FIGS. 7, 8 and 9 which illustrate, in schematic fashion, the overall configuration for electrical power distribution in three embodiments of the instant invention.

Figure 7:
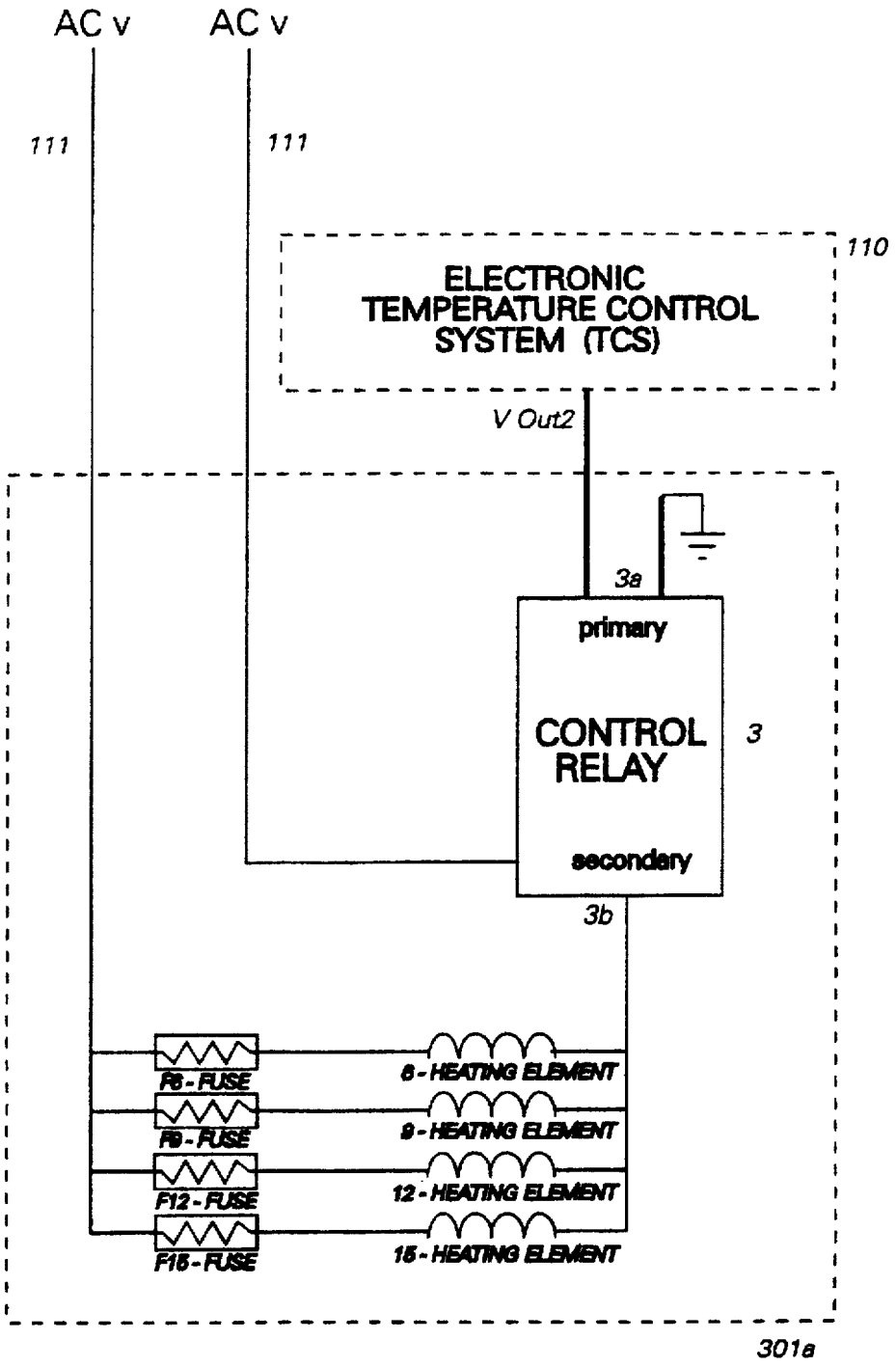
FIG. 7 illustrates, in schematic form, a first embodiment of the temperature control and electrical power distribution and safety systems taught by this invention, which first embodiment incorporates a single redundant high temperature responsive safety means. (See, also, FIG. 6, component 112).

The first and simplest embodiment of the electrical power distribution and safety system, as illustrated in FIG. 7, is a basic single redundant safety system wherein thermal safety switches 101 (which will, as discussed in Section II, above, disengage the flow of electricity to the temperature control system 110 if the system temperature becomes too high) provide a back-up to the safeguards provided by the system's temperature control system 110. The basic electrical power circuit 111 for the device runs from an appropriate external source of alternating electrical voltage (ACv) to the heating elements 6, 9, 12, and 15. However, the circuit 111 can only be closed and electricity supplied to heating elements 6, 9, 12, and 15 when the primary of control relay 3 (designated as primary 3*a*) receives an appropriate control voltage (designated as Vout2) from temperature control system 110, closing the secondary of control relay 3 (designated as secondary 3*b*).

Temperature control system 110 provides a control voltage Vout2 only when the temperature of the fluid falls below a certain "set point" temperature established by the user. Thus, the temperature control system 110 serves as a first level of protection, as it will only engage the control relay 3 when the temperature of the fluid is below a certain set point temperature. Likewise, it serves to interrupt the flow of electricity to the control relay 3 when fluid temperature rises above the aforesaid set point temperature. The addition of one or more bimetallic thermal safety switches 101 in the circuit intermediate the source of electrical power ACv and the temperature control system 110, as discussed in Section II, above, provide a first level of redundancy. Such as system is, therefore, referred to in its system embodiment as a single redundant system.

Figure 8:
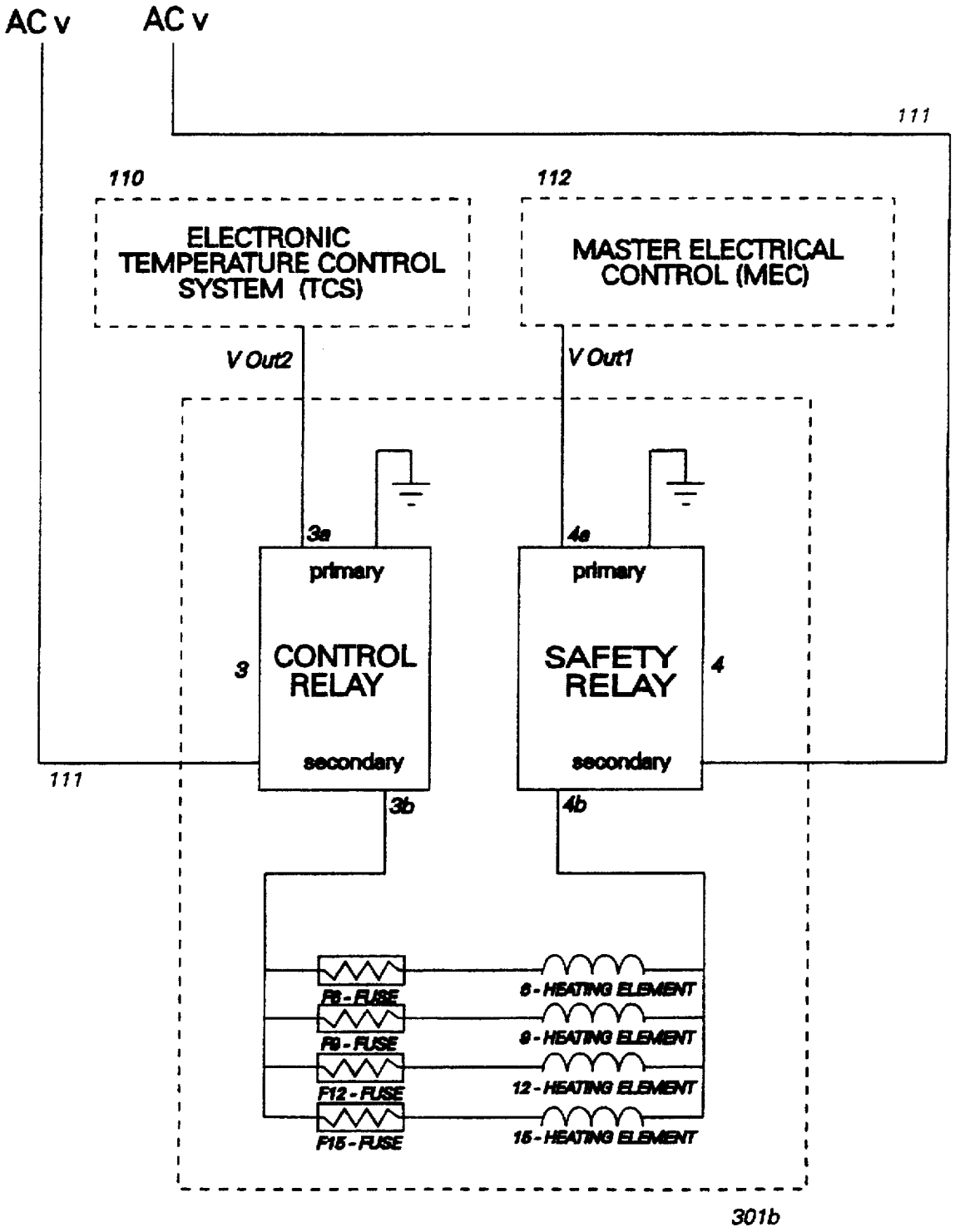
FIG. 8 illustrates, in schematic form, a first preferred embodiment of the temperature control and electrical power distribution and safety systems taught by this invention, which first preferred embodiment incorporates a first type of double redundant high temperature responsive safety means. (See, also, FIG. 6, component 301*b*).
Figure 9:
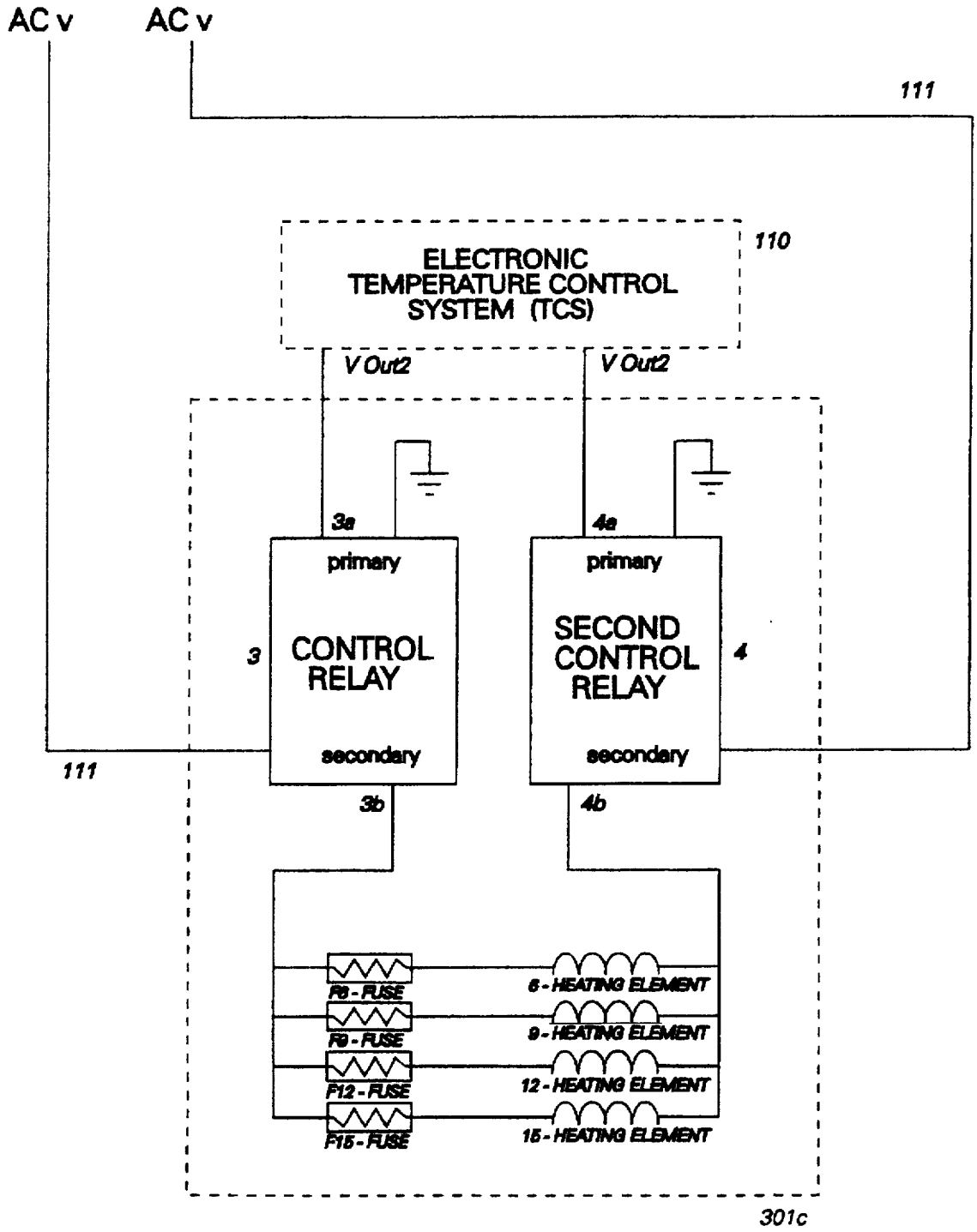
FIG. 9 illustrates, in schematic form, a second preferred embodiment of the temperature control and electrical power distribution and safety systems taught by this invention, which second preferred embodiment incorporates a second type of double redundant high temperature responsive safety means.

Notwithstanding the added safety provided to the invention by the single redundant safety system described above, the inventors deem it advantageous, in the preferred embodiments of this invention, to utilize one of two basic types of double redundant safety systems, as illustrated schematically in FIGS. 8 and 9. In a double redundant safety system, an additional relay (denoted as safety relay 4 in FIG. 8 and second control relay 4 in FIG. 9) is provided in the system. As illustrated in FIG. 8, this additional relay (safety relay 4) may receive its primary voltage input directly via the master electrical control 112 (Vout1). In the alternative, as illustrated in FIG. 9, the additional relay (second control relay 4) may receive its primary voltage input via the temperature control system 110 output (Vout2). In both cases, however, an additional (or double redundant) safeguard is provided against system failure in the form of a failure of the control relay 3 to disengage upon termination of control voltage (Vout2) from the temperature control system 110 to its primary (3*a*).

Figure 10:
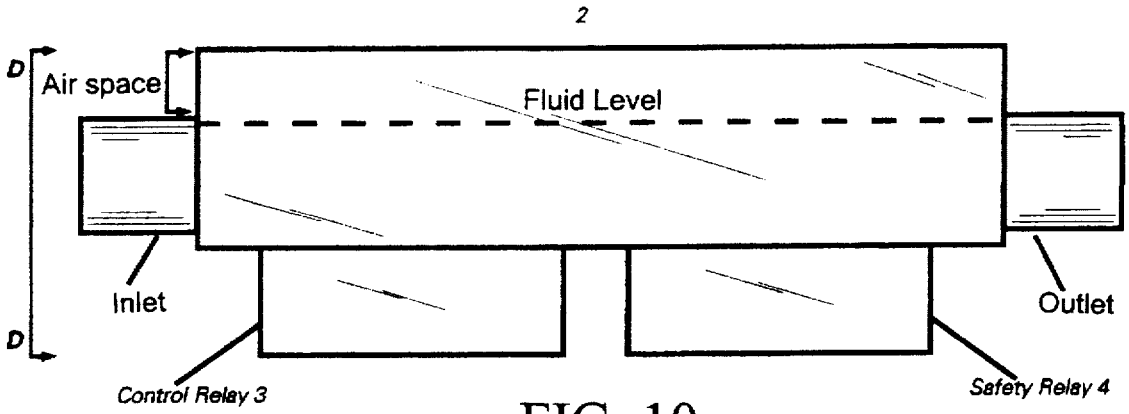
FIG. 10 provides a side view of a first configuration for the disposition of solid state relays so as to allow their cooling while in operation by incoming fluid on a unit incorporating false activation suppression means.
Figure 11:
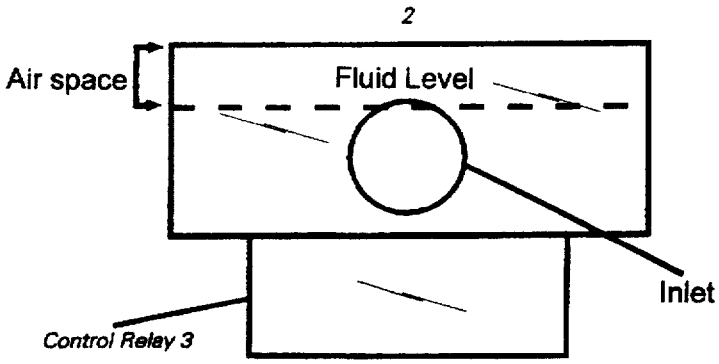
FIG. 11 provides a view taken from D—D of FIG. 10 of a first configuration for the disposition of solid state relays so as to allow their cooling while in operation by incoming fluid on a unit incorporating false activation suppression means.
Figure 12:
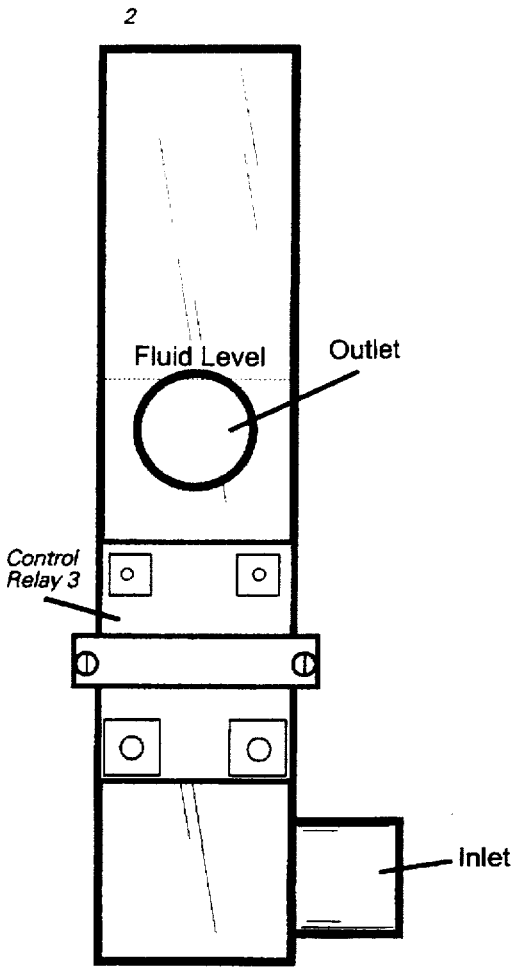
FIG. 12 provides a first side view of a second configuration for the disposition of solid state relays so as to allow their cooling while in operation by incoming fluid on a unit incorporating false activation suppression means.
Figure 13:
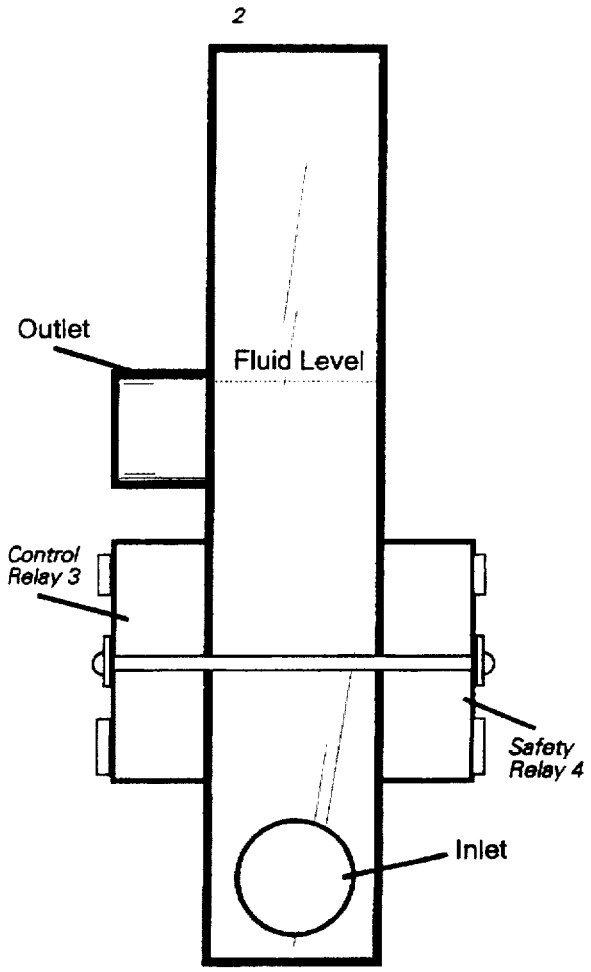
FIG. 13 provides a second side view (at right angles to that provided in FIG. 12) of a second configuration for the disposition of solid state relays so as to allow their cooling while in operation by incoming fluid on a unit incorporating false activation suppression means.
Figure 14:
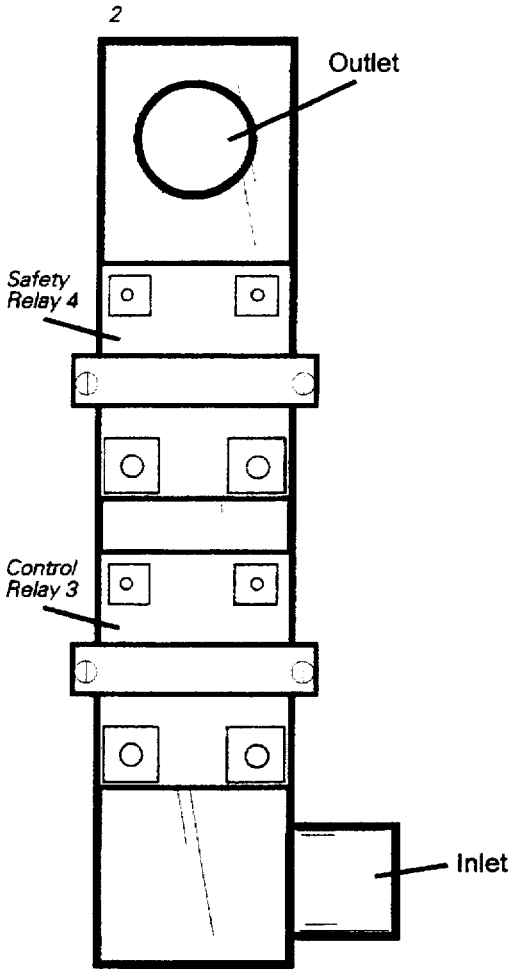
FIG. 14 provides a first side view of a third configuration for the disposition of solid state relays so as to allow their cooling while in operation by incoming fluid.
Figure 15:
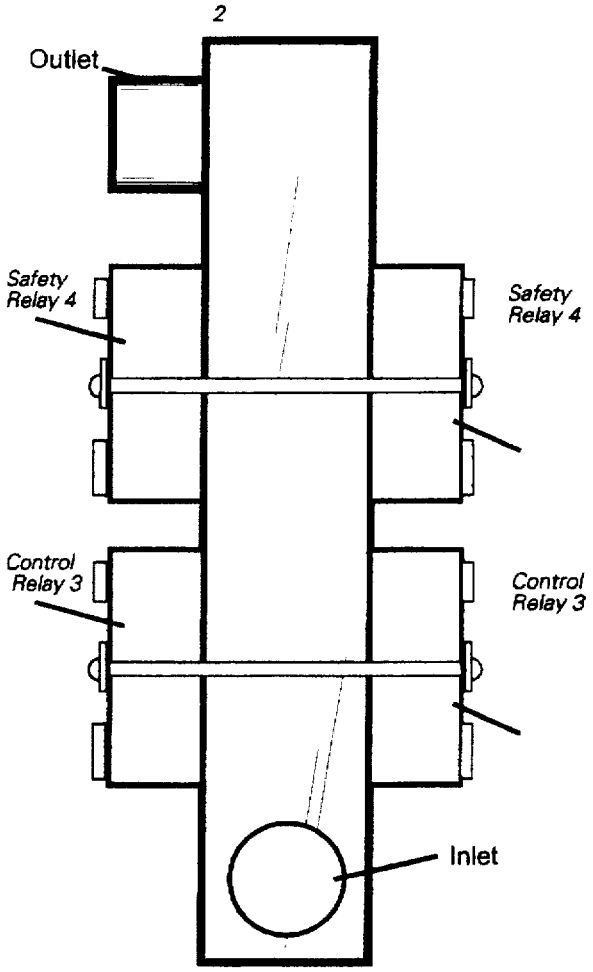
FIG. 15 provides a second side view (at right angles to that provided in FIG. 14) of a third configuration for the disposition of solid state relays so as to allow their cooling while in operation by incoming fluid.
Figure 16:
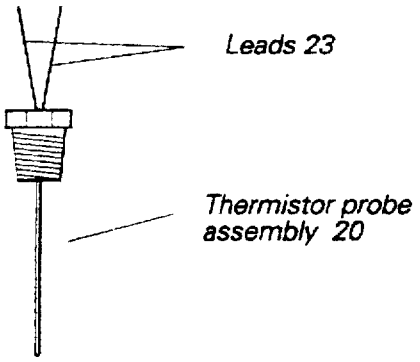
FIG. 16 provides an approximate actual size side view of a micro-miniature thermistor probe assembly employed in the preferred embodiment of the temperature control system characterizing the instant invention.
Figure 17:
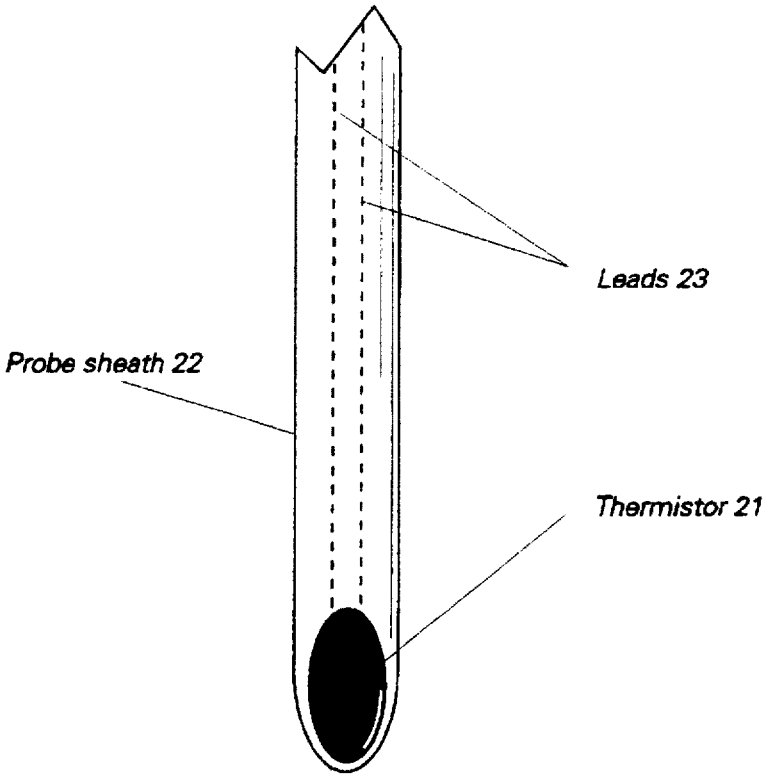
FIG. 17 provides a magnified cross-sectional view of the tip of the micro-miniature thermistor probe assembly employed in the preferred embodiment of the temperature control system characterizing the instant invention.

Three possible variations for the design and configuration of the heat exchange vessel 2 utilized in conjunction with the electrical power distribution and safety system are illustrated in FIGS. 10 through 15. The first configuration, as illustrated in FIGS. 10 and 11, is horizontally disposed. The second configuration, as illustrated in FIGS. 12 and 13, is vertically disposed. The third, which would typically be used in high powered applications of the instant invention, is also vertically disposed and features four solid state relays to accommodate the increased electrical power demands envisioned for its application. (See, FIGS. 14 and 15). As will be noted upon review of FIGS. 10 through 13, the design may allow for a fluid level less than the total volume of the heat exchange vessel 2. The remaining space in each heat exchange vessel 2 is filled with trapped air which acts as a buffer against and helps to suppress false activation of the flow switch 102 of the instant invention due to the pressure fluctuations that normally occur in plumbing systems when non-heated fluid is demanded from the same plumbing system. It should also be noted that heat sink compound may be advantageously used to connect the relays previously described to the heat exchange vessel 2 so as to allow for more efficient heat exchange. (This also allows for maximum heat transfer from the relay(s) to the fluid)

IV. Temperature Control System

The temperature control system utilized in the instant invention may best be understood by reference to FIGS. 6 through 9, 16 and 17 in conjunction with FIG. 1 and the previously discussed figures related to the electrical power distribution and safety system (FIGS. 6 through 9). FIG. 6 provides a circuit diagram of the essential circuits employed in the preferred embodiment of the temperature control system 110 characterizing the instant invention. (See, components numbered 20, 212, 213, 214, 220, 221, 222, 223, 224, 230, and 232, of FIG. 6). As will be noted, the circuits utilized may be divided, and may be classified generally, into three sections. The first such section, which serves as the temperature sensing and voltage linearization section, is comprised of: (1) a regulated low voltage input source Vin1 supplied by the master electrical control 112 (Vout1 in FIG. 6); (2) the microminiature thermistor 21 described below; (3) a calibration resistor 212 for the linearization bridge; and (4) a first adjunct bridge resistor 213 and second adjunct bridge resistor 214 forming the rest of the linearization bridge. (An RTD may be substituted for the thermistor, thereby eliminating the need for linearization circuitry). The second section, which serves as the differential amplification section, is comprised of a first operational amplifier 220. If the resistance of fourth op-amp resistor 224 is equal to the resistance of second op-amp resistor 222, and the resistance of third op-amp resistor 223 equals the resistance of first op-amp resistor 221, then the voltage output of first operational amplifier 220 equals the resistance of fourth op-amp resistor 224 divided by the resistance of third op-amp resistor 223 times the result of the input voltage labelled "–" of first operational amplifier 220 subtracted from the input voltage labelled "+" of first operational amplifier 220 (or R224/R223($^{+}$V–$^{-}$V)). The third section, which forms the comparator section for the circuit, is comprised of a second operational amplifier 230 whose voltage output Vout2 is the on/off trigger for the primary circuits 3*a* of (the preferably solid state) control relay 3 which relays or interrupts the electrical voltage supplied to the heating elements 6, 9, 12, and 15, and a potentiometer 232 utilized for setting the output set point temperature/voltage equivalent. (Control relay 3 relays electrical power in response to the presence of absence of Vout2 at the primary control input 3*a* of control relay 3). As will be noted, the input from the differential amplification section serves as the reference voltage for the second operational amplifier 230.

The unique feature of the above-described circuitry is that it is instantly reactive and there is, therefore, no "dead band" around the set point. It is, in effect, an on/off system in which switching is instantaneous in response to perceived changes in temperature. This allows the heating system utilizing the temperature control system described herein to be switched on and off in slow cycles or extremely rapid bursts as the need therefor naturally occurs and such is necessary to maintain set point temperature and to correct deviations in set point stability that would otherwise result. Thus, in contrast to the slower reacting systems in current usage, which lag in reacting to a signaled decrease in the temperature of the fluid being heated, and (just as importantly) lag in terminating the heating process after receiving a signal that the heat of the fluid exceeds the set point, this system is capable of responding instantaneously. This allows far more sensitive and concise temperature control than has heretofore been achieved without expensive or excessive technology such as microprocessors or computerized control.

However, having solved the problem of creating a system that is instantaneous in its response to a signaled change in fluid temperature solves only part of the concerns addressed by this invention. The extreme efficiency with which the above described system will function is ultimately dependent on the sensitivity of the temperature probe or sensor utilized by the device (i.e.—the speed with which a recognizable signal is provided to the temperature control system by the temperature probe utilized). To solve this problem this invention utilizes an ultrafast micro-miniature thermistor 21 (which is connected to the aforementioned linearization bridge section of the temperature control system 110 via leads 23 contained in the temperature probe 20). See, FIGS. 16 and 17. In preferred embodiments of this invention, a micro-miniature thermistor 21 with a time constant of 1 second (still air to still air), one of the most sensitive available, placed in a stainless steel immersion housing 22 with a time constant of 0.7 seconds (still air to still water), has provided extremely satisfactory results. Micro-miniature thermistor probe assemblies of this type may be acquired (upon providing specifications therefor) from several electronics manufacturers.

As will be obvious upon review of the foregoing, numerous variations are possible without exceeding the ambit and scope of the inventions described herein.

We claim:

1. An electrical power distribution device for use in a fluid heating device, which said fluid heating device utilizes at least one electrical heating element receiving electricity from an external source of electrical power to heat fluid flowing film an external source of fluid while said fluid is passing through the fluid heating device so that said fluid is proximate a certain set-point temperature upon exiting from said fluid heating device, comprising:

at least one electrical heating element;

a heat exchange vessel formed of heat conducting materials, said heat exchange vessel (i) serves to relay a fluid being heated by said at least one electrical heating element, (ii) does not contain said at least one electrical heating element, and (iii) has at least one flat exterior surface wherein said at least one flat exterior surface forms an outer wall of said heat exchange vessel; and at least one engageable electrical relay which is disposed upon said at least one flat exterior surface of said heat exchange vessel in such manner as to be in thermal communication with the fluid being heated flowing through said heat exchange vessel such that said at least one engageable electrical relay (i) is actively cooled by said fluid flow, and (ii) relays electrical power to said at least one electrical heating element only while engaged.

2. An electrical power distribution means for use in a fluid heating device, as described in claim 1, further comprising:

an engageable temperature control means responsive to the temperature of the fluid being heated, which engageable temperature control means must be engaged in order for said at least one engageable electrical relay to be engaged, and which engageable temperature control means regulates the fluid temperature of a fluid being heated is below the set-point temperature; and an engageable master electrical control means responsive to the temperature of the fluid being heated, which engageable master electrical control means must be engaged in order for said engageable temperature control means to be engaged, and which engageable master electrical control means only engages said engageable temperature control means while the temperature of the fluid being heated is below the safety-point temperature.

3. An electrical power distribution means for use in a fluid heating device, as described in claim 2, wherein said engageable master electrical control means includes at least one bimetallic thermal safety switch in thermal communication with the fluid being heated for engaging said temperature control means only while the temperature of the fluid being heated is below the safety-point temperature.

4. An electrical power distribution means for use in a fluid heating device, as described in claim 2, further comprising a second engageable electrical relay, which second engageable electrical relay must be engaged in order for electrical power to flow to said at least one electrical heating element, and which second engageable electrical relay is engaged by the engageable temperature control means.

5. An electrical power distribution means for use in a fluid heating device, as described in claim 2, further comprising a second engageable electrical relay, which second engageable electrical relay must be engaged in order for electrical power to flow to said at least one electrical heating element, and which second engageable electrical relay is engaged by the engageable master electrical control means.

6. An electrical power distribution means for use in a fluid heating device as described in claim 1, wherein said at least one engageable electrical relay is a solid state electrical device.

7. An electrical power distribution means for use in a fluid heating device as described in claim 1, wherein said heat exchange vessel includes false activation suppression means based upon the inclusion of an air space within said heat exchange vessel.

8. An electrical power distribution means for use in a fluid heating device as described in claim 1, wherein the interior of said heat exchange vessel is provided with multiple interior heat exchange surfaces formed from heat conducting materials, which multiple interior heat exchange surfaces are in thermal communication with the heat conducting materials forming the heat exchange vessel in such manner that heat exchange takes place between the said heat exchange vessel and the said multiple interior heat exchange surfaces.

9. A temperature control device for use in a fluid heating device, said fluid heating device utilizes at least one electrical heating element receiving electricity from an external source of electrical power to heat fluid flowing from an external source of fluid while said fluid is passing through the fluid heating device so that said fluid is proximate a certain set-point temperature upon exiting from said fluid heating device, comprising:

at least one electrical heating element;

at least one electrical relay which serves to relay electrical power to said at least one electrical heating element and serves to relay electrical power equally and simultaneously to all electrical heating elements;

a temperature sensor which detects changes in the temperature of a fluid being heated and; positioned so as to be in thermal communication with the fluid being heated; and engageable relay control means which is instantaneously responsive to changes in the temperature of the fluid being heated and detected by said temperature sensor, said engageable relay control means engages all of said electrical relays simultaneously.

10. A temperature control means, as described in claim 9, wherein said temperature sensor is responsive to a low voltage input source, and said engageable relay control means includes a voltage linearization section responsive to a said temperature sensor, a differential amplification section responsive to said voltage linearization section, and a comparator section responsive to said differential amplification section, said comparator section including a potentiometer utilized for setting an output set point temperature/voltage equivalent.

11. A temperature control means, as described in claims 9 or 10, wherein said temperature sensor is an immersible micro-miniature thermistor assembly.

12. A temperature control means, as described in claims 9 or 10, wherein said engageable relay control means engages all electrical relays while the temperature of the fluid being heated is below the set-point temperature as detected by said temperature sensor.

13. An engageable master electrical control device for providing control voltages to low voltage electrically powered components of a fluid heating device, said fluid heating device heats fluid flowing from an external source of fluid while said fluid is passing through the fluid heating device so that said fluid is proximate a certain set-point temperature upon exiting from said fluid heating device, but not above a certain safety-point temperature, comprising:

at least one electrical heating element which is supplied with electrical power by an electrical circuit receiving electricity from an external source of electrical power;

an engageable temperature control means;

at least one electrical supply relay having a primary and a secondary;

an engageable regulated electrical power supply means which serves, while engaged, to (i) supply a first parallel control voltage to the primary of said at least one electrical supply relay, the secondary of said at least one electrical supply relay being part of the electrical circuit supplying electrical power to said at least one electrical heating element, and (ii) to supply a second parallel control voltage to said engageable temperature control means; and an engageable safety means wherein said engageable safety means is not part of the said electrical circuit that supplies electrical power to said at least one electrical heating element and wherein said engageable safety means is engaged in order for said engageable regulated electrical power supply means to be engaged.

14. An engageable master electrical control means as described in claim 13, further comprising an engageable electrical start relay which must be engaged in order to relay electrical power to engage said engageable regulated electrical power supply means.

15. An engageable master electric control means, as described in claim 13, wherein said engageable safety means includes at least one bimetallic thermal safety switch in thermal communication with the fluid being heated.

16. An engageable master electric control means, as described in claim 13, further including overall engagement means, which means must be engaged in order for the said engageable master electrical control means to be engaged.

17. An engageable master electrical control means, as described in claim 16, wherein said overall engagement means includes a flow switch which only engages said master electrical control means in response to a fluid flow.

18. An engageable master electrical control means for use in an instantaneous fluid heating device, as described in claim 13, wherein said engageable master electrical control means includes false activation suppression means.

19. An engageable master electrical control means for use in an instantaneous fluid heating device, as described in claim 18, wherein said false activation suppression means includes the use of a time delayed electrical relay as said engageable electric start relay.

20. An engageable master electrical control means as described in claim 13, wherein said engageable safety means is responsive to the temperature of a fluid being heated, which engageable safety means must be engaged in order to relay electrical power to engage said electrical start relay, and which engageable safety means only engages said engageable electrical start relay while the temperature of the fluid being heated is below the safety point temperature.

21. An instantaneous fluid heating device that receives electricity from an external source of electrical power in order to heat fluid flowing from an external source of fluid while said fluid is passing through said instantaneous fluid heating device so that said fluid is proximate a certain set-point temperature upon exiting from said instantaneous fluid heating device, comprising:

(a) a fluid heating structure, said structure (i) having an inlet through which the fluid being heated enters the fluid heating structure, (ii) having an outlet through which the fluid being heated exits the fluid heating structure, and (iii) being further comprised of a plurality of vessels having hollow interiors, said plurality of vessels being arranged in series with each of said vessels having at least one electrical heating element such that the fluid being heated entering the inlet of the fluid heating structure flows through each of said plurality of vessels past at least one electrical heating element contained in each of said plurality of vessels before exiting through the outlet of said fluid heating structure;

(b) an exit port for emitting the fluid after it has been heated by the fluid heating structure;

(c) engageable electrical power distribution means comprising at least one engageable electrical relay which relays equal amounts of electrical power simultaneously to each electrical heating element while engaged; and (d) an engageable temperature control means which (i) is responsive to the temperature of fluid exiting the fluid heating structure, and (iii only engages said at least one engageable electrical relay while said engageable temperature control means is engaged.

22. An instantaneous fluid heating device as set forth in claim 21, wherein said engageable temperature control means only engages said at least one engageable electrical relay while the temperature of the fluid being heated, when emitted from the exit port, is below the set point temperature.

23. An instantaneous fluid heating device as set forth in claim 54, further comprising an engageable fluid recirculation means, said engageable fluid recirculation means recirculating a majority of the fluid being heated exiting the fluid heating structure back to the inlet of the fluid heating structure before said fluid being heated can exit via the exit port while said engageable fluid heating means is engaged.

24. An instantaneous fluid heating device as set forth in claim 21, 22 or 23, further comprising an electrical power distribution means having a heat exchange vessel with a hollow interior, said heat exchange vessel being formed of heat conducting materials, which said heat exchange vessel (i) serves to relay a fluid being heated to the inlet of said fluid heating structure, (ii) does not contain any electrical heating element, (iii) has at least one flat exterior surface which said at least one flat exterior surface forms an outer wall of the said heat exchange vessel, and (iv) has said at least one engageable electrical relay disposed upon said at least one flat exterior wall of said heat exchange vessel in such manner as to be in thermal communication with the fluid being heated flowing through said heat exchange vessel such that said at least one engageable electrical relay is actively cooled by said fluid flow.

25. An instantaneous fluid heating device as described in claim 24, further comprising an engageable temperature control means having:

a temperature sensor which detects changes in the temperature of a fluid being heated and is positioned so as to be in thermal communication with the fluid being heated; and engageable relay control means which is instantaneously responsive to changes in the temperature of the fluid being heated detected by said temperature sensor, which engageable relay control means engages each of said at least one electrical relay simultaneously, and which engageable relay control means only engages each of said at least one electrical relays while engaged and while the temperature of the fluid being heated is below the set-point temperature as detected by said temperature sensor.

26. An instantaneous fluid heating device, as set forth in claim 24, further comprising engageable master electrical control means having:

an engageable regulated electrical power supply means which serves, while engaged, to (i) supply a first parallel control voltage to the primary of said at least one engageable electrical relay, the secondary of said at least one engageable electrical relay being part of the electrical circuit supplying electrical power to the at least one electrical heating element contained in each of said plurality of vessels, and (ii) to supply a second parallel control voltage to said engageable temperature control means; and an engageable safety means, which engageable safety means is not part of the electrical circuit that includes the at least one electrical heating element in each of said plurality of vessels and which engageable safety means must be engaged in order for said engageable regulated electrical supply means to be engaged.

27. An instantaneous fluid heating device as set forth in claim 25, further comprising an engageable master electrical control means having:

an engageable regulated electrical power supply means which serves, while engaged, to (i) supply control voltages to the primary of said at least one engageable electrical relay, the secondary of said at least one engageable electrical relay being part of the electrical circuit supplying electrical power to the at least one electrical heating element contained in each of said plurality of vessels, and (ii) to supply control voltages to said engageable temperature control means; and an engageable safety means, which engageable safety means is not part of the electrical circuit that includes the at least one electrical heating element contained in each of said plurality of vessels and which engageable safety means must be engaged in order for said engageable regulated electrical supply means to be engaged.

28. An instantaneous fluid heating device as described in claim 25, further including a flow switch which only engages said engageable master electrical control means when fluid is being emitted from said exit port.

29. An instantaneous fluid heating device as described in claim 26, further including a flow switch which only engages said engageable master electrical control means when fluid is being emitted from said exit port.

30. An instantaneous fluid heating device, as set forth in claim 21, wherein each of said vessels is equal in heating capacity.

31. An instantaneous fluid heating device that receives electricity from an external source of electrical power in order to heat fluid flowing from an external source of fluid while said fluid is passing through said instantaneous fluid heating device so that said fluid is proximate a certain set-point temperature upon exiting from said instantaneous fluid heating device, comprising:

(a) a fluid heating stricture, said structure (i) having an inlet through which the fluid being heated enters the fluid heating structure, (ii) having an outlet through which the fluid being heated exit the fluid heating structure, and (iii) being further comprised of a plurality of vessels having hollow interiors, said plurality of vessels being arranged in series with each of said vessels having at least one electrical heating element such that the fluid being heated entering the inlet of the fluid heating structure flows through each of said plurality of vessels past at least one electrical heating element contained in each of said plurality of vessels before exiting through the outlet of said fluid heating structure;

(b) an exit port for emitting the fluid after it has been heated by the fluid heating structure;

(c) an engageable fluid recirculation means which when engaged recirculates a majority of the fluid being heated exiting the fluid heating structure back to the inlet of the fluid heating structure before said fluid being heated can exit via the exit port;

(d) engageable electrical power distribution means, said means comprising at least one engageable electrical relay, said at least one engageable electrical relay relays electrical power to each, of said electrical heating elements while engaged; and (e) an engageable electronic temperature control means which (i) is responsive to the temperature of fluid exiting the fluid heating structure, and (ii) only engages said at least one engageable electrical relay while said engageable electronic temperature control means is engaged.

32. An instantaneous fluid heating device as described in claim 31, wherein said engageable electronic temperature control means only engages said at least one engageable electrical relay while the temperature of the fluid being heated when emitted from the exit port is below the set point temperature.

33. An instantaneous fluid heating device as described in claims 31 or 32, wherein said electrical power distribution means includes a heat exchange vessel formed of heat conducting materials, which said heat exchange vessel (i) serves to relay a fluid being heated to the inlet of the fluid heating structure, (ii) does not contain any electrical heating element, (iii) has at least one flat exterior surface which said at least one flat exterior surface forms an outer wall of the said heat exchange vessel, and (iv) has said at least one engageable electrical relay disposed upon said at least one flat exterior wall of said heat exchange vessel in such manner as to be in thermal communication with the fluid being heated flowing through said heat exchange vessel such that said at least one engageable electrical relay is actively cooled by said fluid flow.

34. An instantaneous fluid heating device as described in claim 31 or 32, wherein said engageable temperature control means includes:

a temperature sensor which detects changes in the temperature of a fluid being heated and is positioned so as to be in thermal communication with the fluid being heated; and engageable relay control means which is instantaneously responsive to changes in the temperature of the fluid being heated detected by said temperature sensor, which engageable relay control means engages all of said electrical relays simultaneously, and which engageable relay control means only engages all electrical relays while engaged and while the temperature of the fluid being heated is below the set-point temperature as detected by said temperature sensor.

35. An instantaneous fluid heating device as described in claim 33, wherein said engageable temperature control means includes:

a temperature sensor which detects changes in the temperature of a fluid being heated and is positioned so as to be in thermal communication with the fluid being heated; and engageable relay control means which is instantaneously responsive to changes in the temperature of the fluid being heated detected by said temperature sensor, which engageable relay control means engages all of said electrical relays simultaneously, and which engageable relay control means only engages all electrical relays while engaged and while the temperature of the fluid being heated is below the set-point temperature as detected by said temperature sensor.

36. An instantaneous fluid heating device as described in claim 31 or 32, further comprising an engageable master electrical control means having:

an engageable regulated electrical power supply means which serves, while engaged, to (i) supply control voltages to the primary of said at least one engageable electrical relay, the secondary of said at least one engageable electrical relay being part of the electrical circuit supplying electrical power to said at least one electrical heating element, and (ii) to supply control voltages to said engageable temperature control means; and an engageable safety means, which engageable safety means is not part of the electrical circuit that includes said at least one electrical heating element and which engageable safety means must be engaged in order for said engageable regulated electrical supply means to be engaged.

37. An instantaneous fluid heating device, as described in claim 33, further comprising an engageable master electrical control means having:

an engageable regulated electrical power supply means which serves, while engaged, to (i) supply control voltages to the primary of said at least one engageable electrical relay, the secondary of said at least one engageable electrical relay being part of the electrical circuit supplying electrical power to said at least one electrical heating element, and (ii) to supply control voltages to said engageable temperature control means; and an engageable safety means, which engageable safety means is not part of the electrical circuit that includes said at least one electrical heating element and which engageable safety means must be engaged in order for said engageable regulated electrical supply means to be engaged.

38. An instantaneous fluid heating device, as described in claim 34, further comprising an engageable master electrical control means having:

an engageable regulated electrical power supply means which serves, while engaged, to (i) supply control voltages to the primary of said at least one engageable electrical relay, the secondary of said at least one engageable electrical relay being part of the electrical circuit supplying electrical power to said at least one electrical heating element, and (ii) to supply control voltages to said engageable temperature control means; and an engageable safety means, which engageable safety means is not part of the electrical circuit that includes said at least one electrical heating element and which engageable safety means must be engaged in order for said engageable regulated electrical supply means to be engaged.

39. An instantaneous fluid heating device, as described in claim 35, further comprising an engageable master electrical control means having:

an engageable regulated electrical power supply means which serves, while engaged, to (i) supply control voltages to the primary of said at least one engageable electrical relay, the secondary of said at least one engageable electrical relay being part of the electrical circuit supplying electrical power to said at least one electrical heating element, and (ii) to supply control voltages to said engageable temperature control means; and an engageable safety means, which engageable safety means is not part of the electrical circuit that includes said at least one electrical heating element and which engageable safety means must be engaged in order for said engageable regulated electrical supply means to be engaged.

40. An instantaneous fluid heating device as described in claim 36, further including a flow switch which only engages said engageable master electrical control means when fluid is being emitted from said exit port.

41. An instantaneous fluid heating device as described in claim 37, further including a flow switch which only engages said engageable master electrical control means when fluid is being emitted from said exit port.

42. An instantaneous fluid heating device as described in claim 38, further including a flow switch which only engages said engageable master electrical control means when fluid is being emitted from said exit port.

43. An instantaneous fluid heating device as described in claim 39, further including a flow switch which only engages said engageable master electrical control means when fluid is being emitted from said exit port.

44. An instantaneous fluid heating device, as set forth in claim 31, wherein each of said vessels is equal in heating capacity.

* * * * *

UNITED STATES PATENT AND TRADEMARK OFFICE

CERTIFICATE OF CORRECTION

PATENT NO. : 5,784,531

DATED : July 21, 1998

INVENTOR(S) : Robert W. Mann and Herman H. Hall, Jr.

It is certified that error appears in the above-identified patent and that said Letters Patent is hereby corrected as shown below:

Column 1, lines 46-49: delete the following:

"(It should be noted that other forms of temperature control such as proportional, PID, fuzzy logic, and staged as commonly known within the art could be used to achieve satisfactory temperature regulation.)"

Column 6, line 36: insert the following:

--(It should be noted that other forms of temperature control such as proportional, PID, fuzzy logic, and staged as commonly known within the art could be used to achieve satisfactory temperature regulation.)--

Column 9, line 62: "regulator 107 L provides" should read --regulator 107 provides--; and line 63: "Voult" should read --Vout l--.

Column 14, line 11: "film" should read --from--.

Column 15, line 38: "and; positioned" should read --and is positioned--.

UNITED STATES PATENT AND TRADEMARK OFFICE

CERTIFICATE OF CORRECTION

PATENT NO. : 5,784,531

DATED : July 21, 1998

INVENTOR(S) : Robert W. Mann and Herman H. Hall, Jr.

It is certified that error appears in the above-identified patent and that said Letters Patent is hereby corrected as shown below:

Column 17, line 24: "and (iii only" should read --and (ii) only--;

line 30: "heated, when" should read --heated when--; and line 34: "claim 54," should read --claim 21--.

Column 18, line 66: "heated exit the" should read --heated exits the--.

Column 19, line 20: "each, of said" should read --each of said--.

Signed and Sealed this

Sixteenth Day of March, 1999

*Attest:*

Q. TODD DICKINSON

*Attesting Officer*

*Acting Commissioner of Patents and Trademarks*